US006933896B2

(12) United States Patent
Sward et al.

(10) Patent No.: US 6,933,896 B2
(45) **Date of Patent: *Aug. 23, 2005**

(54) EXTENDABLE PLANAR DIVERSITY ANTENNA

(75) Inventors: Douglas Alan Sward, Midvale, UT (US); Brent Madsen, Providence, UT (US); Carlos Rios, Los Gatos, UT (US); Jeffrey Jones, Orem, UT (US); Robert Yarbrough, San Diego, CA (US); Nhan T. Nguyen, Brighton, MA (US)

(73) Assignee: 3Com Corporation, Marlborough, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/408,394

(22) Filed: Apr. 7, 2003

(65) Prior Publication Data

US 2003/0210199 A1 Nov. 13, 2003

(Under 37 CFR 1.47)

Related U.S. Application Data

(63) Continuation of application No. 09/658,140, filed on Sep. 8, 2000, now Pat. No. 6,545,643.

(51) Int. Cl.[7] ..... H01Q 1/24; H01Q 1/42

(52) U.S. Cl. ..... 343/702; 343/872; 343/795; 343/700 MS

(58) Field of Search ..... 343/702, 700 MS, 343/853, 893, 737, 795, 872; 455/90.3, 351; H01Q 1/24, 1/42

(56) References Cited

U.S. PATENT DOCUMENTS

| | | | | | |
|---|---|---|---|---|---|
| 5,657,028 | A | * | 8/1997 | Sanad | 343/700 MS |
| 5,918,163 | A | * | 6/1999 | Rossi | 455/558 |
| 5,943,018 | A | * | 8/1999 | Miller | 343/702 |
| 5,990,838 | A | * | 11/1999 | Burns et al. | 343/702 |
| 6,172,645 | B1 | * | 1/2001 | Hollander et al. | 343/702 |
| 6,295,031 | B1 | * | 9/2001 | Wallace et al. | 343/702 |
| 6,437,745 | B1 | * | 8/2002 | Vaisanen et al. | 343/702 |
| 6,509,876 | B1 | * | 1/2003 | Jones et al. | 343/702 |
| 2001/0043160 | A1 | * | 11/2001 | Hirai et al. | 343/702 |

* cited by examiner

*Primary Examiner*—Trinh Vo Dinh
(74) *Attorney, Agent, or Firm*—Workman Nydegger

(57) ABSTRACT

The present invention is a retractable/extendable diversity antenna that provides the appropriate polarization in a horizontal orientation. The antenna structure is placed within a Type II PCMCIA PC card package and may be extended or retracted with one touch. The antenna structure is large enough to provide for the diversity antenna design and may optionally be housed within a PCMCIA Type II PC Card. At least one spring-loaded mechanism is used to extend the antenna structure beyond the PCMCIA PC Card package and to provide stability while the antenna structure is in the extended position. The diversity antenna configuration may consist of either two miniature, planar antenna modules or two etched printed circuit board contours that are spaced as far apart as possible with a minimum separation of a quarter wave length distance in order to provide mitigation to radio multipath fading effects. The antenna modules have orientations perpendicular to each other such that the polar nulls representative of their radiation patterns remain spatially orthogonal.

33 Claims, 9 Drawing Sheets

EXTENDABLE PLANAR DIVERSITY ANTENNA

CROSS REFERENCE TO RELATED APPLICATIONS

This is a continuing application of U.S. application Ser. No. 09/658,140, filed Sep. 8, 2000, now U.S. Pat. No. 6,545,643, which is incorporated herein by reference.

BACKGROUND OF THE INVENTION

1. Field of the Invention

The present invention relates generally to antenna structures coupled to electronic devices. More specifically, the present invention concerns extendable antennas for portable expansion cards.

2. The Prior State of the Art

Various communication systems are used to allow electronic devices, such as laptop computers, to communicate and exchange data and other types of information. For example, various networks, including Local Area Networks (LAN), Internet, Ethernet and conventional telephone networks, often link computers. These known communication systems, however, usually require the computer to be physically connected to telephone lines, modems or specialized wiring. In some locations, however, it is difficult if not impossible to be physically connected to the communication system. Additionally, these known systems generally cannot be used if the user is traveling or moving to different locations, as is typically the case with a laptop computer.

Wireless or cellular telephone systems enable portable expansion devices to connect laptop computers to a communication system. One such configuration is a cellular telephone system coupled to a portable expansion device, because the computer does not have to be connected to an existing telephone line. In addition, cellular telephone systems are very useful in connection with portable computers because the cellular communication circuitry can be miniaturized and provided as a component of the computer or placed on a portable expansion card.

Another particularly effective configuration allowing laptop computers to communicate is a Wireless LAN (WLAN) system. Some WLAN systems implement the IEEE 802.11 wireless standard, a protocol standard that resolves many interoperability issues among the manufacturers of WLAN equipment. The 802.11 standard requires both a medium access control (MAC) comprised of several functional blocks and a physical (PHY) control including diffused infrared, direct-sequence spread-spectrum (DSSS) and frequency-hopping spread spectrum (FHSS). Specifically, 802.11 supports DSSS for use with binary phase shift keying (BPSK) modulation at a 1-Mbit/second data rate (with higher data rates also deployed and developed) and quadrature phase shift keying (QPSK) modulation at a 2-Mbit/second data rate. The DSSS has an RF modulation bandwidth of 22 MHz (null to null). Both spread spectrum techniques are typically used in the 2.4-GHz band, because of its wide availability in many countries and the lower hardware costs as compared to higher microwave frequencies. WLAN systems and cellular telephone systems are both part of the latest technology craze attempting to integrate wireless communication onto portable electronic devices, and more specifically onto a portable expansion card. Portable expansion cards developed when the industry recognized that standardization of peripheral devices would, among other things, greatly increase the demand for them.

Exemplary portable expansion cards include solid-state interface cards, PC Cards, ATA (Advanced Technology Attachment) cards, Compact Flash cards, SmartMedia cards, SSFDC (Solid State Floppy Disk Cards), or other miniature expansion card devices. Several manufacturers collaborated to form the Personal Computer Memory Card International Association (PCMCIA), which developed and promulgated standards for the physical design, dimensions, and electrical interface of portable expansion devices. Specifically, the PCMCIA PC Card standard identifies three primary card types: Type I, II, and III. These PC Card types correspond to physical dimension restrictions of 85.6 mm (length)×54.0 mm (width) and height restrictions of up to 3.3 mm: (Type I), 5.0 mm (Type II), and 10.5 mm (Type III). Now, many electronic devices being manufactured, especially those having a reduced size, are adapted to accommodate these standards. Laptop computers, in particular, are increasingly popular for both business and personal applications due in part to the development of PC Card peripheral devices designed to increase the functionality of the computers. As an example, PC cards are commonly used with portable and laptop computers to provide added features and/or functions. For instance, PC cards are often configured to function as memory cards, wireless network interface cards (NIC), sound cards, modems, or other devices that supply add-on functionality.

In the case of the wireless NIC, one of the greatest difficulties in moving the added wireless features to the PC Card is placement of all the necessary components on the PC Card. Specifically, the antenna structures presently used take up too much space within the PC Card housing and requires the short-range wireless stack, link manager, RF baseband, power amp, and other radio components to be placed on limited printed circuit board (PCB) space. In diversity radios, the PCB space shortage is further amplified by the need for multiple antenna structures and the related spatial separation requirements of the antenna structures. In fact many wireless NIC manufacturers are forced to extend the antenna structure past the PC Card specification via a fixed endcap structure. This permanent extension exposes the antenna structure to continual risk of damage as long as the PC Card is in the laptop computer expansion slot, whether or not the PC Card is active.

The WLAN and cellular telephone wireless systems previously mentioned often require specialized antennas, such as a diversity antenna structure used with the aforementioned diversity radio. Antenna structures, predominantly used for communication, efficiently transmit and receive electromagnetic energy in the form of radio waves. Antenna structures are used whenever it is impractical, or impossible to use a physical connection, such as a transmission line or wave-guide. In order to get the best performance out of the wireless antenna, the antenna must not be obstructed by anything within its path of radiation.

Antenna design attempts to achieve good impedance matching to the feeding transmission line to maximize the available power for radiation. Often the power levels are limited by transmission standards. For example "Bluetooth" wireless technology is a de facto standard, as well as a specification for small-form factor, low-cost, short-range radio links between laptops, phones, and other portable digital devices. One of the present Bluetooth specifications is to limit the transmission range to around 10 meters. Thus, while a Bluetooth antenna is designed to distribute the radiation optimally, it has a limited transmission range due to the wireless standard.

Antenna design also attempts to achieve the best compromise between the various constraints imposed on the desired radiation pattern. Optimization of the radiation pattern may include maximizing the radiation in one direction and suppressing it in others. If a specific desired radiation pattern is difficult or impossible to obtain using a single antenna, antenna engineers will often resort to designing arrays of simple antennas. Adjustment of the amplitude and phase of the feed voltages to the various elements in the array, as well as the geometrical arrangement of these elements, often achieves the desired radiation characteristics. Unfortunately, antenna array design is complicated by the mutual interaction between the various elements in the array and the operating environment of the array.

One example of a more difficult operating environment with multiple mutual interacting components that affect the desired radiation patterns is a laptop computer. Different brands of laptop computers use different shielding components for electromagnetic interference (EMI) that affect the antennas quite dramatically from one vendor to another. For example, some laptop computers use conductive materials or fillers, such as exotic conductive plastic material, that interfere with fully integrated antenna arrays in the PC Card housing. Of course, the laptop display screen also presents a difficult shielding problem of the radiation pattern depending on how the antenna is configured. Furthermore, a user is generally positioned in front of the laptop computer, thereby blocking a portion of the receiving area and obstructing the desired radiation pattern. Obstruction by the user is especially important with a low power wireless signal, where it is easy to block the signals and to absorb the radiation pattern.

To compensate for these difficulties many wireless NIC configurations utilize an external antenna structure that is selectively detachable from the portable expansion card and can be placed away from the laptop environment. Conventional external antenna structures used to connect a computer to a wireless communication system or cellular telephone are typically placed externally of the computer because of the noise, interference, obstruction and shielding caused by the various components of the computer. In particular, conventional antenna structures do not function correctly if they are obstructed or shielded by the housing or other structures of the computer.

Conventional antenna structures are also generally rigid and they protrude a relatively long distance from the body of the computer. These protruding antennas are often large, unwieldy, aesthetically unpleasing and they make the computer difficult to move and transport. In addition, these antennas are often bent, broken, knocked out of alignment or otherwise damaged because they can easily catch or strike foreign objects such as people, walls, doors, etc. Further, these known antennas require a large support structure to secure the antenna to the housing of the portable expansion device and this support structure requires a considerable amount of valuable space inside the body of the portable expansion device. Despite its size, the support structure is often damaged when the antenna is accidentally moved.

It is known that the repair and replacement of conventional antennas and the associated support structure is difficult and costly. In fact, the entire antenna assembly is often removed and replaced instead of attempting to repair a portion of the antenna or support structure. Thus, the repair and replacement of the antenna and/or antenna support structure is expensive and time consuming.

In order to alleviate these problems, known antennas are often removed before the computer is moved or transported. Additionally, known antennas must often be removed before the computer can be inserted into its carrying case. Disadvantageously, this requires additional time and resources to remove and reattach the antenna each time the computer is moved. Additionally, the antenna is often misplaced, lost or damaged when it is detached from the computer. Further, because the user often does not want to take the time and effort to remove the antenna, the computer is moved with the antenna still attached to the computer and this frequently results in the antenna being damaged or broken.

Additionally, it is well known that an antenna should usually be placed in a vertical position to obtain the optimum signal strength. This is because the antenna is most often located just above a conducting horizontal plane such as a metal desktop, which acts as a reflecting ground plane that attenuates horizontal components of the electromagnetic wave. Further, this and other conventional antennas have limited connectivity when the antenna extends in a horizontal plane and the housing of the computer may obstruct or shield the antenna. As such, most retractable antennas require additional adjustments once they are extracted, such as vertical repositioning via pivot points. These pivot points are also subject to failure overtime at a moving joint. The repair and replacement of these integrated antennas is difficult and costly. In fact, the entire attached PC Card assembly is often removed and replaced instead of attempting to repair a portion of the integrated antenna or support structure. Thus, repair or replacement of the integrated antenna in the PC Card is expensive and time consuming.

Presently, integrated retractable antenna diversity solutions are not found. Single antenna solutions do not have adequate radiation coverage considering the operating environment of most digital devices. A single antenna may also be partially blocked by the operator or an object that is between the antenna and its intended point of communication. Poor coverage, mechanical reliability, aesthetics, blockage of a single antenna due to an intervening object or multipath are all problems with these non-diversity solutions. Most attempted extendable antenna designs lack stability and robustness and force the design to go to a permanently extended solid endcap antenna structure.

SUMMARY OF THE INVENTION

The present invention has been developed in response to the current state of the art, and in particular, in response to these and other problems and needs that have not been fully or completely solved by currently available retractable antenna structures for portable expansion devices. Thus, it is an overall aspect of the present invention to provide a robust retractable diversity antenna design that does not consume PCB space via dual planar antenna and slide mechanisms associated with a robust retractable antenna bridge. This can be accomplished by orienting two planar antenna modules perpendicular to each other such that the polar nulls representative of their radiation pattern remain spatially orthogonal.

In one embodiment, a robust retractable diversity antenna bridge uses two guide mechanisms located on opposite sides of the portable expansion device to provide stability to the antenna bridge while it is in the extended position. The antenna bridge is large enough to provide the protection and spatial diversity needed in a diversity antenna, but the body of the antenna bridge is minimized to reduce the retracted footprint inside a PCMCIA Type II PC Card package. Mating metal contacts are used to provide the necessary electrical interconnect between the antenna bridge and the circuitry inside the PC Card. Metal contacts travel horizontally along the path of two tracks. These metal contacts come together when the antenna bridge is fully extended and provide the electrical interconnect to the radiating elements of the antenna. The close proximity of the metal contacts to the tracks minimize the space needed for electrical interconnect. Light emitting diode (LED) indicators may also be placed in the electrical loop to provide a functional indication of antenna bridge activities. The diversity antenna bridge configuration also includes two miniature, planar antenna modules or etched PCB contours, which are spaced as far apart as possible to mitigate the radio multipath fading effects. These perpendicularly oriented antenna modules are essentially horizontal dipoles providing outstanding coverage.

Another configuration of the antenna design provides a robust extendable antenna that is more compatible to the operational environment in which it is to be used. With the extendable feature, the antenna can be retracted when transporting the laptop that the PCMCIA Card is installed in without having to remove the PCMCIA Card from the laptop. Antenna diversity provides enhanced radio reception robustness compared to non-diversity implementations.

Yet another configuration of the present invention relates to a retractable antenna bridge or platform for use with electronic devices. The retractable antenna bridge or platform includes at least one compression spring to provide an extension force necessary to extend the antenna from the electronic device. A cam track system is used not only to guide the extension and retraction of the retractable antenna bridge or platform but also to hold the antenna in a retracted position. In addition to providing a system for extending and retracting a antenna bridge or platform, the present invention also provides an electrical connection between the antenna and the electronic device.

In one configuration, the compression spring preferably directs the extension force towards the center of the retractable antenna bridge. The centrally directed extension force not only provides for the retraction and extension of the retractable antenna bridge, but also effectively minimizes any moment arm or binding force introduced by a user. As a result, the extension and retraction of the antenna bridge is smooth and does not bind.

In yet another configuration, the compression spring includes a circuit that is bonded to one side of the compression spring using, for example, a pressure sensitive adhesive. Bonding the circuit to the compression spring constrains the movement of the circuit, which protects the circuit from fracturing or from being pinched. The compression spring preferably connects to both the retractable antenna platform and the electronic device through the use of zero insertion force (ZIF) connectors. ZIF connectors provide for a simplified connection process, lower manufacturing costs, and product automation.

In another configuration, the lateral motion of the retractable antenna bridge is constrained or limited by a guide structure that is integrated with the retractable antenna bridge. The guide structure has a slot that fits over a post connected with the electrical device. The guide structure permits the retractable antenna bridge to experience a full range of motion relating to the extension and the retraction of the retractable antenna bridge while simultaneously minimizing the lateral motion of the retractable antenna bridge. Additionally, a compression spring may be mounted within the slot to assist in minimizing the lateral motion of the connector as well as assisting in the extension and retraction of the antenna bridge.

Another configuration activates antenna circuitry once the antenna bridge is fully extended. The antenna circuitry controls a functionally illuminated indicator, such as a LED, electrically connected to the two planar antennas. The circuitry is preferably matched with the characteristic impedance of the transmission feed line, although an alternative configuration synthesizes the necessary characteristic impedance on the portable expansion device.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims. These and other objects and features of the present invention will become more fully apparent from the following description and appended claims, or may be learned by the practice of the invention as set forth hereinafter.

BRIEF DESCRIPTION OF THE DRAWINGS

In order that the manner in which the above recited and other advantages and objects of the invention are obtained, a more particular description of the invention briefly described above will be rendered by reference to specific embodiments thereof which are illustrated in the appended drawings. Understanding that these drawing depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The present invention extends to both methods and systems of wireless communication using extendable/ retractable antennas associated with portable expansion devices. The embodiments of the present invention may comprise a special purpose or general-purpose computer electrically connected to a portable expansion device configured for wireless communication via various computer hardware configurations, as discussed in greater detail below.

Embodiments within the scope of the present invention also include portable expansion devices for carrying or having retractable/extendable diversity or non-diversity antenna structures stored thereon. Such portable expansion devices can be any available media that can be accessed by a general purpose or special purpose computer. By way of example, and not limitation, such portable expansion devices can comprise solid-state interface cards, PCMCIA PC Cards, ATA (Advanced Technology Attachment) cards, Compact Flash cards, SmartMedia cards, SSFDC (Solid State Floppy Disk Cards), other miniature expansion card devices, or any other medium which can be used to carry or store desired antenna means in the form of retractable/extendable diversity or non-diversity antenna structures and which can be accessed by a general purpose or special purpose computer. The retractable/extendable diversity or non-diversity antenna structures facilitate wireless communication from a special purpose or general-purpose computer to a network or another communications connection via either a wireless connection or a combination of hardwired or wireless connections.

Antenna structures comprise, for example, patch antennas, aperture antennas, reflector antennas, lens antennas, fractal antennas, wire antennas, etched PCB contour antennas, other planar antenna structures, or any other medium that can be used to collimate, focus, and effectively direct the electromagnetic energy to be radiated. Exemplary wire antennas include loop, straight wire, helix, or spiral antennas. Exemplary patch antennas are usually square or rectangular printed antennas formed on a PCB or ceramic material, these planar type antennas transceive signals in a spherical coverage pattern but don't transceive signals directly behind them. One such planar antenna is the inverted 'F' antenna, a hybrid of the patch antenna. The inverted F antenna is a cross-polarized antenna. Fractal antenna structures give a user similar wireless performance; the antenna structure is designed predominantly according to the primary operating environment of the laptop computer.

Figure 1:
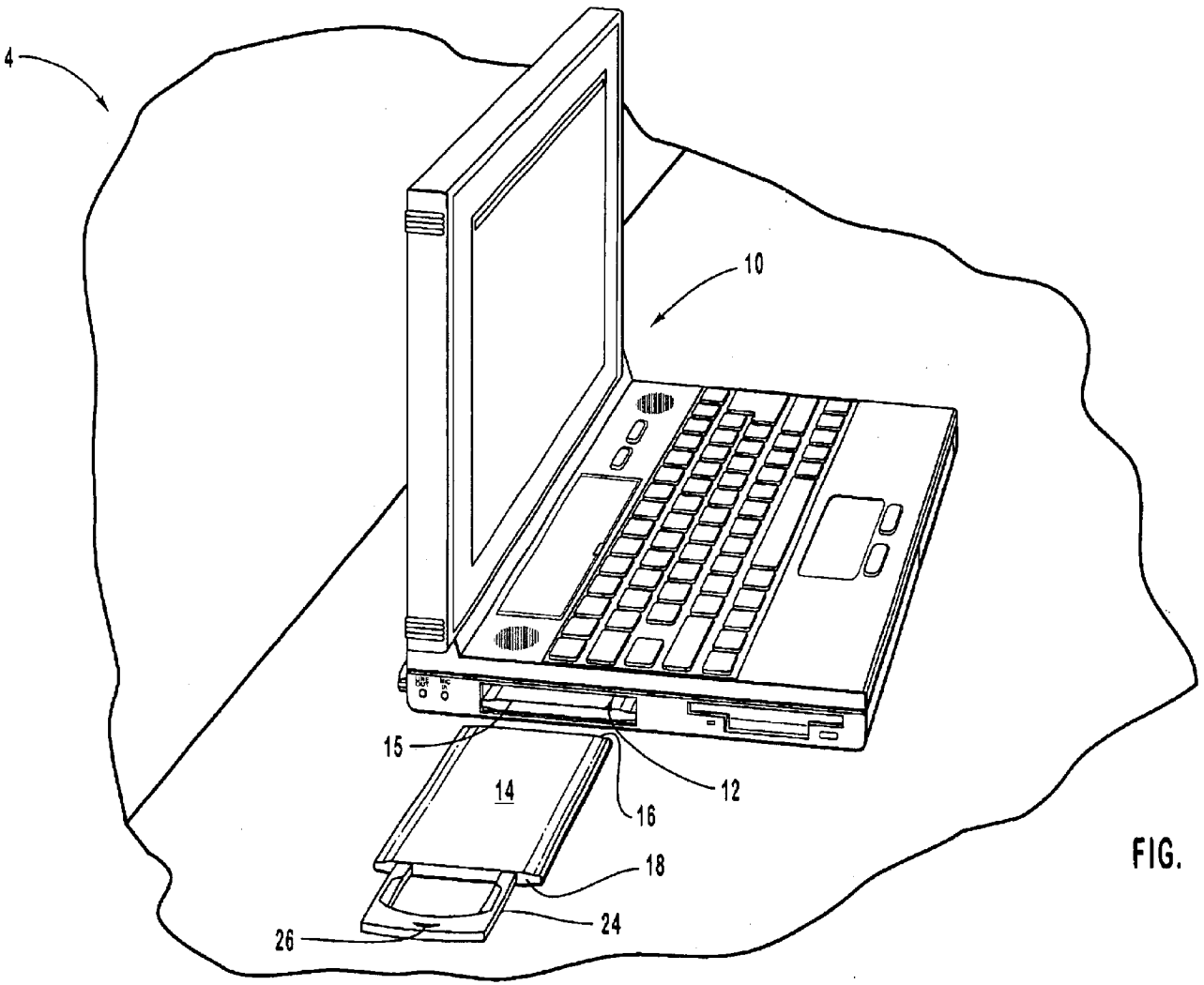
FIG. 1 illustrates an exemplary system that provides a suitable operating environment for the present invention.

FIG. 1 and the following discussion are intended to provide a brief, general description of a suitable computing environment 4 in which the invention may be implemented. Although not required, the invention will be described in the general context of portable expansion devices, such as PC Cards, that integrate antenna structures, such as planar diversity antennas, within the portable expansion device to enable laptop computers to communicate in wireless network environments. Generally, antenna structures include support structures, radiating elements, and an antenna interface with a characteristic impedance connected to a feeding transmission line.

Those skilled in the art will appreciate that the invention may be practiced in network computing environments with many types of computer system configurations, including personal computers, hand-held devices, multi-processor systems, microprocessor-based or programmable consumer electronics, network PCs, minicomputers, mainframe computers, and the like. The invention may also be practiced in distributed computing environments, where tasks are performed by local and remote processing devices that are linked, either by wireless links or by a combination of hardwired or wireless links, through a communications network. In a distributed computing environment, antenna modules may be located in both local and remote processing devices.

With reference to FIG. 1, an exemplary system or environment 4 for implementing the invention includes a general-purpose computing device in the form of a conventional laptop computer 10, including a processing unit, a system memory, portable expansion slots 12, and a system bus that couples various system components including the expansion slots to the processing unit. The portable expansion slot 12 is configured to receive portable expansion devices 14 and 15. Expansion slots 12 allow for insertion of the aforementioned upgrade modules into standard compatible slot interfaces, such as the PCMCIA PC Card standard that identifies three primary card types: Type I, II, and III. The PCMCIA interface is electrically connected to the system bus. The system bus may be any of several types of bus structures including a memory bus or memory controller, a peripheral bus, and a local bus using any of a variety of bus architectures. The interface 16 of portable expansion device 14 is configured to detachably connect with a high-speed connector (not shown) inside slot 12. Inserting portable expansion device 14 in slot 12 permits portable expansion device 14 to be in electrical and physical communication with computer 10.

The portable expansion device 14 also includes an antenna structure 24, which is illustrated in FIG. 1 as a retractable diversity antenna bridge in the extended position, but may also be of any antenna structure type, including but not limited to the other antenna structure embodiments disclosed in this application. The antenna bridge also comprises functional LED 26 for indicating wireless activity via the wireless NIC. When used in a WLAN networking environment, the computer 10 is connected to the local network through a wireless network interface or adapter on portable expansion device 14. When used in a WLAN networking environment, the computer 10 includes a wireless link, or other means for establishing communications over the wide area network, such as the Internet.

The computer 10 may operate in a networked environment using logical connections to one or more remote computers. These remote computers may be another personal computer, a server, a router, a network PC, a peer device or other common network node, and typically include many or all of the elements described above relative to the computer 10. Such wireless networking environments are possible, but not yet commonplace in office-wide or enterprise-wide computer networks, intranets and the Internet.

The wireless capable portable expansion device 14 contains a radio that may either be a diversity or non-diversity radio. Diversity wireless systems or radios generally provide better performance than similar non-diversity systems. A diversity system is highly desirable because it effectively combats the most common problem with wireless equipment, namely, signal dropouts or multipath, when RF signals arrive at a location via different transmission paths, consisting of a combination of direct and reflected signals. Under these conditions, the output can be noisy, lost, or undecipherable. These problems generally occur in closed areas where metal objects are present, but may also exist in other environments. Diversity systems are able to avoid signal dropouts because they have two antennas and two receiver channels. Special circuits in the receiver select the signal from the antenna and receiver channel with the best signal. Because the chances that there will be a simultaneous signal dropout at both antennas are extremely low, diversity systems avoid signal dropouts. Diversity systems can also improve the useful operating range for wireless systems. This is because, even when there are no actual signal dropouts, the amount of signal available or strength of signal available at long ranges can be reduced. This can cause the wireless system to briefly lose the wireless signal well before the transmitter is truly out of range. With a diversity system, complete signal loss is unlikely and the operating range is extended. Two common types of diversity systems include a true diversity and a phasing diversity. In general, true diversity has a superior performance over phasing diversity. However, the true diversity equipment is also more expensive to manufacture, making the phasing diversity equipment acceptable in many situations.

While there are many inherent advantages of a diversity system, there are other aspects of wireless system design that can be important. For example, a high quality non-diversity wireless system will often perform better than a poorly designed or cheaply made diversity system. This is especially true in areas where signal interference is a serious problem. Additionally, diversity equipment is more expensive to purchase than similar non-diversity equipment. As such, the use of a non-diversity system should also be considered for situations where interference might be a serious problem and the cost of a diversity system of comparable quality is too expensive.

Exemplary diversity wireless protocols include the IEEE 802.11 RF wireless standards: 802.11 HR, 802.11b, and 802.11 @5 GHz standards. Other diversity wireless protocols include HiperLan, HiperLan II, and OpenAir wireless protocols. Exemplary non-diversity wireless protocols include the Bluetooth protocol, HomeRF protocol, and SWAP protocol. Although many of the non-diversity wireless protocols are developing a diversity operational mode so that they might enjoy the previously mentioned advantages of diversity radios, the present invention enables non-diversity protocols to enjoy the benefits of antenna diversity immediately while maintaining the interference related benefits of non-diversity.

Bluetooth, which is only one example of a non-diversity short-range wireless standard, is actually a combination of specialized computer chips and software. Bluetooth enables users to connect to a wide range of computing and telecommunications devices easily and simply, without the need to buy, carry, or connect cables. Bluetooth creates rapid ad hoc connections with other Bluetooth capable devices, thereby creating the possibility of automatic connections between digital devices. These connections can be used for a variety of purposes, for example to automatically update E-mail. Bluetooth virtually eliminates the need for additional or proprietary cabling to connect individual peripheral devices, because a single Bluetooth communication port can maintain at least 8 separate high-speed connections. The standard transfer rate for these high-speed Bluetooth connections is up to one megabyte per second, over 17 times as fast as a typical modem. Because Bluetooth can be used for a variety of purposes, it will also potentially replace multiple cable connections via a single radio link.

A preferred embodiment of the present invention is a dual planar antenna configuration, where the antenna modules are spaced as far apart as possible, with a minimum of a quarter wavelength separation. Thereby mitigating radio multipath fading effects via the antenna module spacing. In a preferred configuration the antenna modules are essentially horizontal dipoles that have orientations perpendicular to each other such that the polar nulls representative of their radiation patterns remain spatially orthogonal. While a preferred embodiment utilizes a dual planar antenna configuration, other integrated antenna array configurations may be acceptable.

The use of a planar diversity type antenna is preferred, because they are very integratable into the PC Card. Unfortunately, a single antenna bridge is subject to the interference previously mentioned with regards to the laptop environment, specifically the laptop itself can block the radiation pattern of low power signals. In fact, different brands of laptops create different operating environments for antenna systems. For example various electrical cages, used in the laptop for shielding, affect the PC Card antenna system in dramatically different ways from one vendor to another. It is thus preferred to have the antenna structure extend from the PC Card housing in a manner such that interference from the operating environment is reduced, while the antenna structure is still reasonably protected from external damage. Another configuration utilizes the IEEE 802.11 wireless standard as the preferred protocol for use with the present invention, because it allows the PC Card to use more power in relation to its radiation pattern than other WLAN protocols. Higher radiation strengths make the placement of the PCMCIA expansion card slots on the laptop less important to the overall performance of a PC Card based antenna structure.

Frequency independent antennas may also be designed and used in the present invention to provide equal performance over a broad frequency band. In one configuration, the antenna structure is composed of different types of antennas. For example, a PC Card wireless NIC with an antenna bridge structure may use one type of edge a third type of antenna. Another acceptable configuration is a patch antenna that is circularly polarized. Circular polarization may give better coverage or may mitigate reflections that a user experience in the standard operating environment. For example, if one surrounding building is predominantly horizontally polarized and another surrounding building is predominantly vertically polarized the normal antenna will only receive one type of polarized signal. If the antenna is a vertically polarized antenna, then the antenna is not going to pick up horizontal polarization very well, which is the same as not working, because the signal is often low power to begin with. So a user may choose one antenna, such as a circular polarized patch antenna, over another just because the antenna works better in different operating environments. Combinations of the above should also be included within the scope of antenna structures.

Figure 2B:
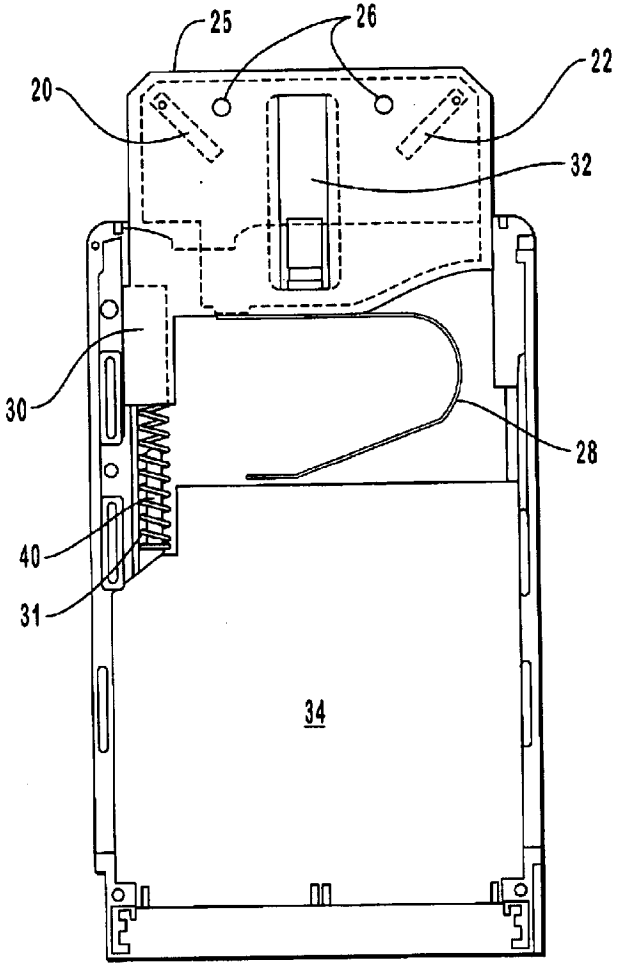
FIGS. 2A and 2B show perspective views of a retractable/extendable platform antenna.
Figure 2A:
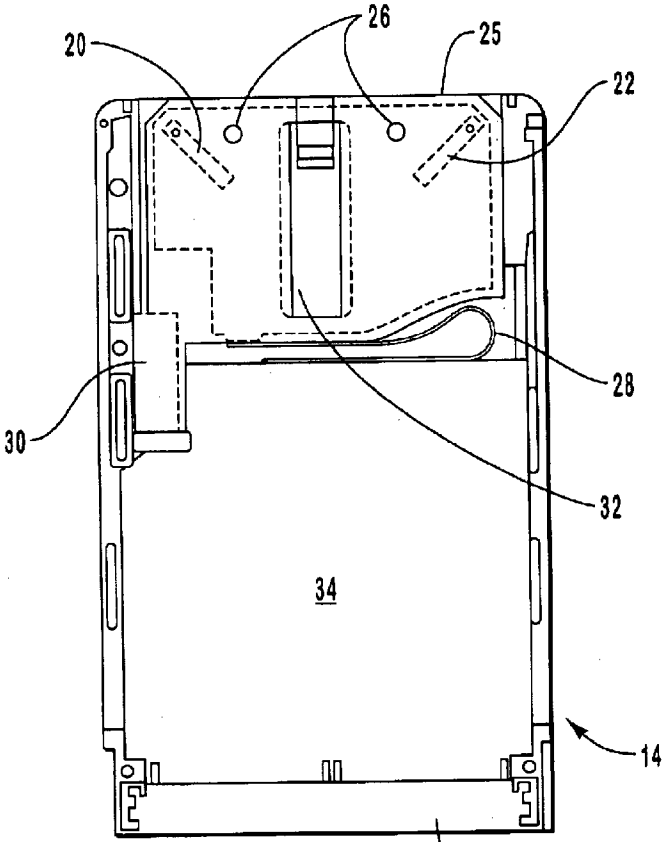

Reference is next made to FIGS. 2A and 2B, depicting a retractable/extendable platform antenna. The wireless portable expansion device 14 comprises retractable antenna platform 25, a PCMCIA interface 16 (FIG. 1), flex circuit 28, printed circuit board (PCB) 34, guide structure 30, and post 40. Specifically, FIGS. 2A and 2B illustrate a retractable platform for use with PCMCIA electronic devices. The retractable antenna platform 25 includes a compression spring 31 to provide an extension force necessary to extend the antenna platform from the electronic device 14. A cam track system is used not only to guide the extension and retraction of the retractable antenna platform 25 but also to hold the platform in a retracted position. In addition to providing a system for extending and retracting an antenna platform, the present invention also provides an electrical connection between the platform and the electronic device.

As previously mentioned, wireless systems often require specialized antennas. Antenna platform 25 can be used with diversity wireless communication systems and includes at least two antenna elements 20 and 22, each including a radiating element, which is equal in length to some fraction of the wavelength to be transmitted or received. In order to increase the efficiency of communication, a minimum distance of one-quarter wavelength separates the antenna elements 20 and 22. The elements 20 and 22 are preferably orientated normal to each other to provide the necessary separation and spatial diversity. Depending on the protocol the antenna elements 20 and 22 on the retractable antenna platform 25 may either be electrically connected in series or be electrically isolated from each other. As each antenna element is oriented normal to the other, there are several possible configurations, which provide the necessary coverage.

The retractable antenna platform 25 uses a compression spring to extend the antenna horizontally into a position that allows a desired radiation pattern from the antenna. When the antenna is retracted, a cam track and cam follower design (discussed in more detail in FIGS. 5*a* and 5*b*) prevents the compression spring from extending the antenna prematurely. The compression spring is usually located along one side of the antenna platform 25 and the force provided by the compression spring is directed along a side of the antenna.

In one embodiment, the spring preferably directs the extension force towards the center of the retractable platform. The centrally directed extension force not only provides for the retraction and extension of the retractable platform, but also effectively minimizes any moment arm or binding force introduced by a user. More specifically the wider antenna structure allows a binding force or moment arm to be introduced into the extension and retraction process that is not usually present in the case of a regular platform system. The spring 31 reduces the likelihood that the binding force will prevent the compression spring and cam track system from functioning properly. For instance, without the spring minimizing the binding force, the wider antenna structure could separate from the cam track system by displacing the cam follower from the cam track. The centrally directed extension force of the spring allows for smooth non-binding extension and retraction of the platform.

In another preferred embodiment, the lateral motion of the retractable platform is constrained or limited by a guide structure 30 that is integrated with the retractable platform. The guide structure 30 has a slot that fits over a post 40 connected with the electrical device. The guide structure 30 permits the retractable platform 25 to experience a full range of motion relating the to extension and the retraction of the retractable platform while simultaneously minimizing the lateral motion of the retractable platform. Also, additional and/or alternative guide structure configurations can be implemented to provide similar support and guide functions; one example of which is designated at 32 in FIGS. 2A and 2B. Additionally, a compression spring may be mounted within the slot to assist in minimizing the lateral motion of the connector as well as assisting in the extension and retraction of the platform.

In another embodiment, the likelihood the flex circuit 28 fracturing or malfunctioning due to the continued movement of the flex circuit is reduced by bonding a circuit to one side of the spring using, for example, a pressure sensitive adhesive. Bonding the circuit to the spring constrains the movement of the circuit, which protects the circuit from fracturing or from being pinched. In this configuration, the spring preferably connects to both the retractable platform and the electronic device through the use of zero insertion force (ZIF) connectors. ZIF connectors provide for a simplified connection process, lower manufacturing costs, and product automation.

Figure 3:
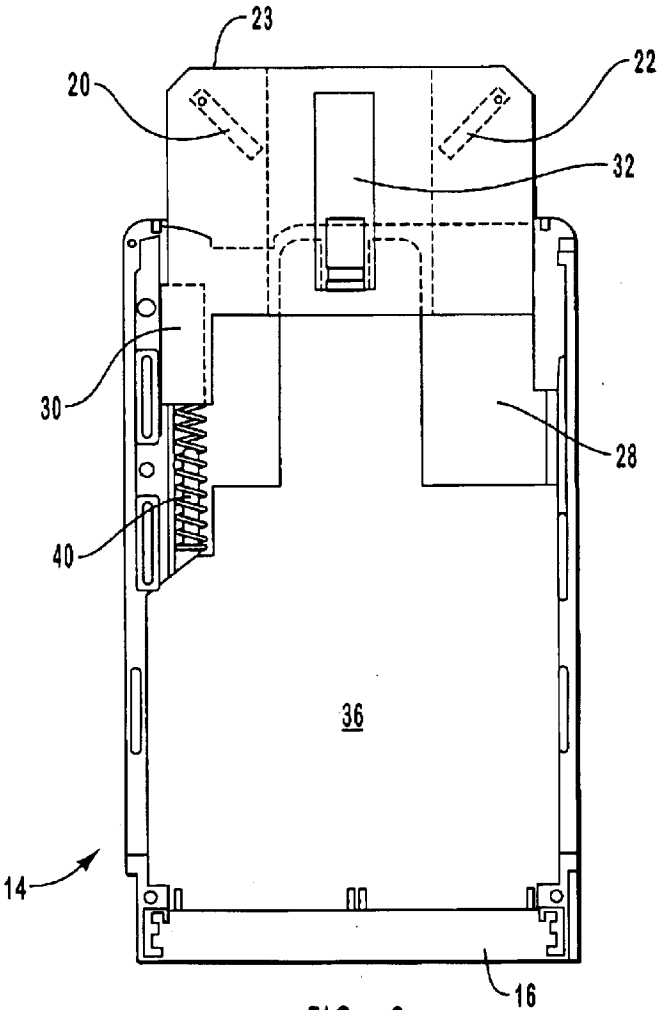
FIG. 3 is a perspective view of a modified single retractable/extendable platform antenna with additional PCB space.

Reference is next made to FIG. 3, illustrating another embodiment of the retractable/extendable platform antenna wherein the platform is redesigned to allow for additional height-restricted space on PCB 36. The wireless portable expansion device 14 comprises modified retractable antenna platform 23, PCMCIA interface 16, PCB 36 with the additional height restricted space, guide structure 30, and post 40. The modified retractable antenna platform 23 includes a hollow section of the platform that passes over a height-restricted space of the PCB 36 when in the retracted position. Electronic components located on this section of PCB 36 must stay within height restrictions dictated by the platform 23.

Figure 4B:
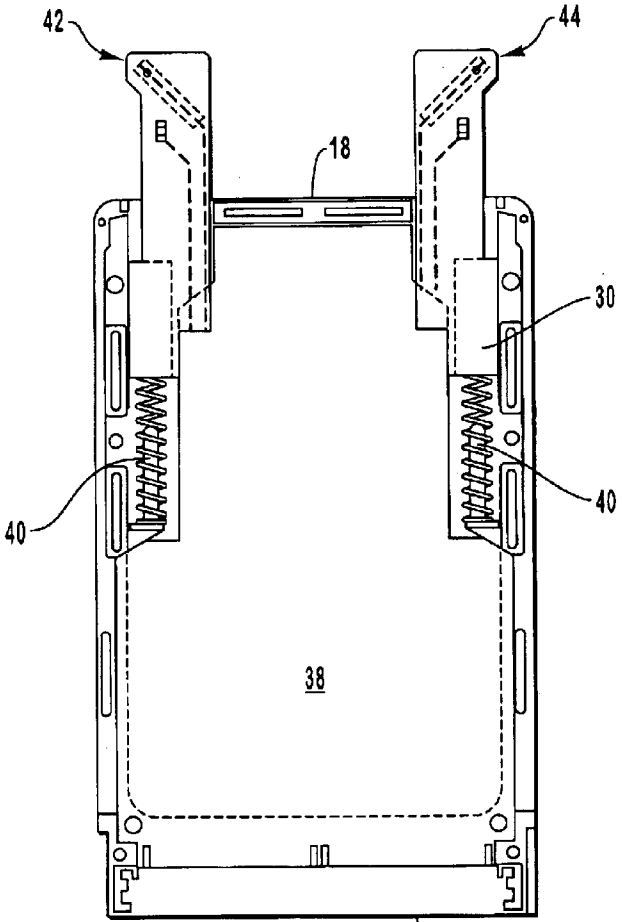
FIGS. 4A and 4B show perspective views of a PC Card based diversity antenna with dual retractable/extendable antenna arms.
Figure 4A:
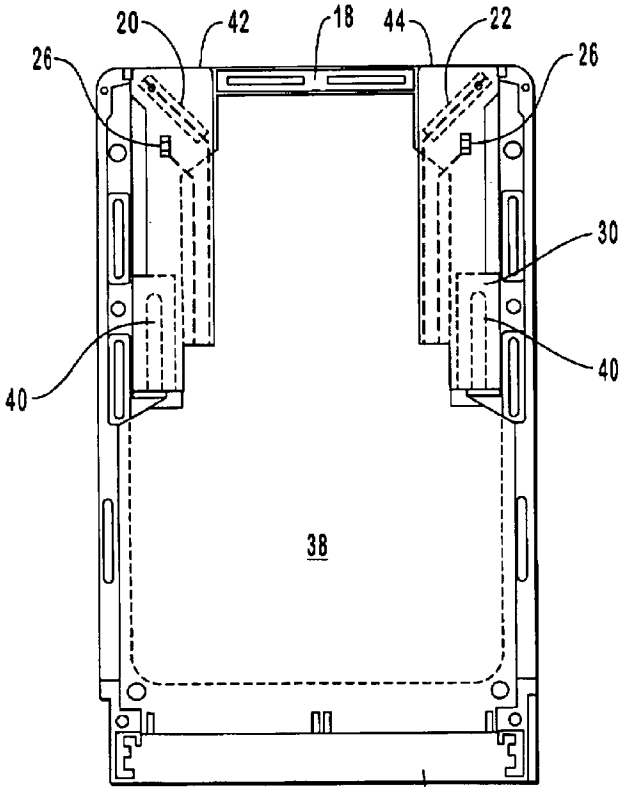

Reference is next made to FIGS. 4A and 4B, illustrating a dual guide structure diversity antenna configuration. In this embodiment, the PC card 14 is no longer burdened with the large antenna platforms of FIGS. 2 and 3. This increases the available PCB space to more than 4 square inches on a Type II PCMCIA PC card. The dual antenna arm configuration comprises PCB 38, antenna arms 42 and 44, PCMCIA interface 16, and housing interface 18. Antenna arms 42 and 44 are individually configured similar to the previously described retractable antenna platform, in that each retractable antenna arm uses a compression spring to extend the antenna arm horizontally into a position that allows a desired radiation pattern from the antenna. When the antenna arm is retracted, a cam track and cam follower design (discussed in more detail in FIGS. 5A and 5B) prevents the compression spring from extending the antenna arm prematurely. In an alternative configuration, only one cam system is used for both antenna arms 42 and 44, so that both arms are either retracted or extended. Each antenna arm optionally has a functional LED 26 to indicate activity across the antenna elements 20 and 22.

Figure 5B:
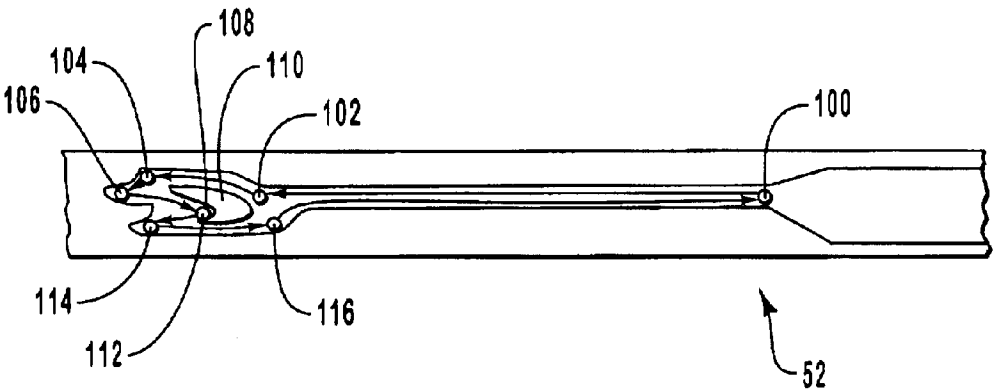
FIG. 5B is a side view illustrating the various states of a cam system for use with the retractable/extendable antenna structures in FIGS. 1, 2, 3, 4, 7, and 9.
Figure 5A:
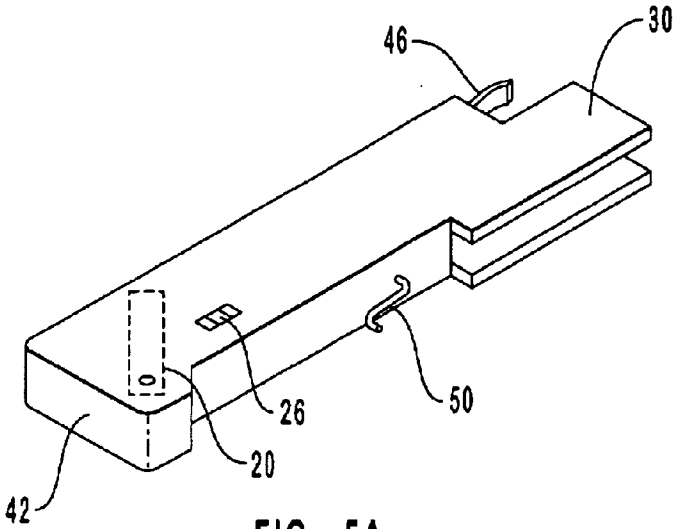
FIG. 5A is a perspective view of one retractable/extendable antenna arm as illustrated in FIG. 4.

The retraction and extension of a retractable antenna arm is more fully illustrated in FIGS. 5A and 5B, which illustrate antenna arm 42 and a cam track 52 respectively. The antenna arm 42 is one example of a retractable antenna structure used with a portable expansion device. The cam track 52 is usually disposed within the body of the PCMCIA card. In a preferred embodiment, the antenna arm 42 usually has a cam follower 50 that follows the cam track 52 and is utilized to extend and retract the antenna arm 42. A similar configuration is used on one side of the antenna platform and the antenna bridge configurations, because if it is used on both sides the cam tracks can get out of synch with each other making extraction very difficult. However, both the antenna platform and the antenna bridge use guide channels to maintain stability of the overall antenna structure.

Assuming the antenna arm 42 is in the extended position, the cam follower 50 is at position 100 within the cam track 52. To retract the antenna arm 42 within the body of the card 14, the cam follower 50 follows the arrows illustrated in the cam track 52 through positions 102, 104, and 106. As the cam follower 50 proceeds through these positions, the compression spring is being compressed. When the cam follower is at position 106, the user ceases to depress the antenna arm 42 into the card 14 and the compression spring attempts to expand. However, the shape of the cam track 52 in combination with the stop 110 causes the cam follower to come to rest at position 108. The antenna arm 42 is effectively held in a retracted position by the force of the compression spring against stop 110.

When the antenna arm 42 is extended, a user depresses the antenna arm 42 and the shape of the cam track 52 causes the cam follower 50 to proceed from position 112 through positions 114 and 116. Because the cam track 52 causes the cam follower 50 away from the stop 110, the compression spring provides the force that extends the antenna arm 42 until the cam follower 50 is in an extended position and occupies the position 100. In this manner, the antenna arm 42 may be repeatedly retracted and extended as needed.

Figure 6B:
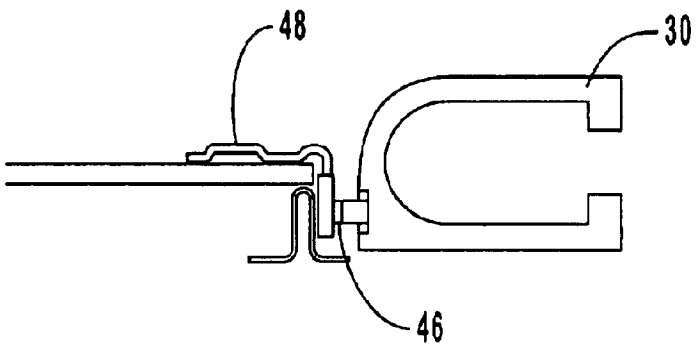
FIGS. 6A and 6B show perspective views of various antenna contact interfaces for use in conjunction with the retractable/extendable antennas illustrated in FIGS. 1, 4, 7, and 9.
Figure 6A:
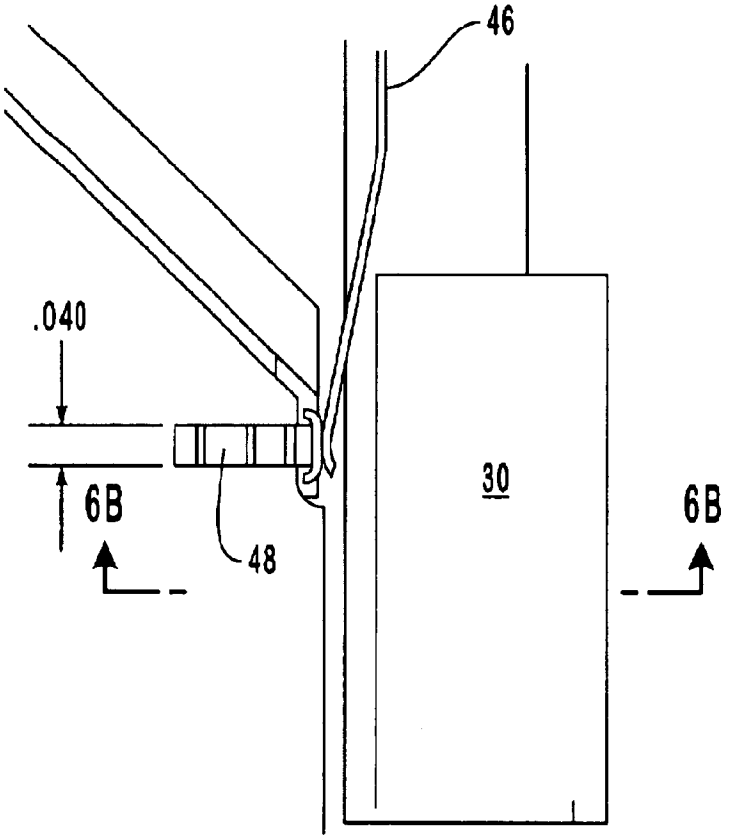

Reference is next made to FIGS. 6A and 6B, which illustrate a preferred embodiment of the contact interfaces associated with various embodiments of the antenna arm, antenna platform, antenna bridge, and other antenna structure configurations. Mating metal contacts are used to provide the necessary electrical interconnect between the antenna platform and the circuitry inside the PCMCIA PC card. One half of the metal contacts travel along the path of the slide tracks. The two halves of the metal contacts come together at the end of the slide stroke to make the electrical interconnect to the antenna. The close proximity of the metal contacts to the slide tracks keep the space required for electrical interconnects to a minimum. The contacts transmit and receive the signals generated by the wireless NIC components for radiation between the PCB and the antenna element.

Figure 8:
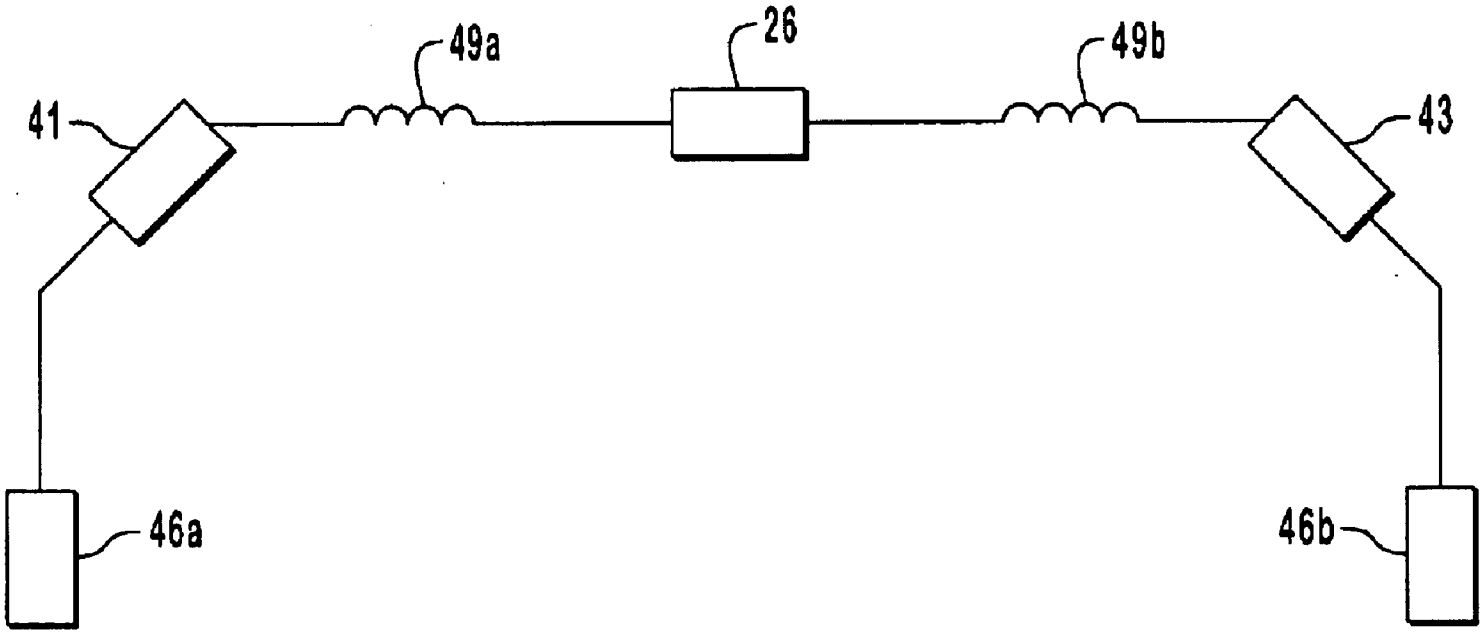
FIG. 8 is a circuit diagram of one antenna structure for use with the present invention.

In conjunction with a preferred circuit diagram illustrated in FIG. 8, the antenna structures preferably use two contacts and a ground. The main contact is via contact wires 46 and the functionally illuminated indicator is activated when the contact wire 46 rests on contact 48. The contact wire is fixedly attached to the guide structure 30 so that it brushes along a contact shield affixed to the PCB. Each contact point multitasks by broadcasting transmission and reception signals between the antenna and the PCB components, but it also carries current for the functional LED indicator. This series configuration also allows PCB circuitry to synthesize an impedance to maximize the power available for radiation. Although this diversity antenna could be used as a Bluetooth antenna structure, the horizontal antenna structure increases its performance substantially when connected to a 20 DBm radio, such as an IEEE 802.11 wireless radio.

A functionally illuminated indicator is a display which, by way of simple illumination, specific illumination color, specific color combinations, intermittent illumination flashing patterns, color combination combined with flashing patterns or other illumination schemes, indicates an attribute of a device or system to which the indicator is connected. One example of functional illumination, not to be construed as limiting the scope of the present invention, is a PC card LED indicator that contains two LEDs, typically of different colors. This type of connector interface is commonly used with a network adapter card where one LED is configured to illuminate thereby indicating that a signal is being received from the network while the second LED is configured to illuminate thereby indicating that network traffic or activity is present on the line. Another example of functional illumination, given by way of example and not limitation, is an illumination scheme used on some network adapters with optional topologies, such as a network adapter capable of providing access using speed or bandwidth topologies. These adapters may use a three LED scheme with one LED indicating network signal, another LED indicating a short-range wireless connection, and the third LED indicating signal strength. Functional illumination may also indicate whether a card or peripheral device is inserted or connected properly. Functional illumination may also comprise illumination that indicates the location of the antenna bridge.

Figure 7B:
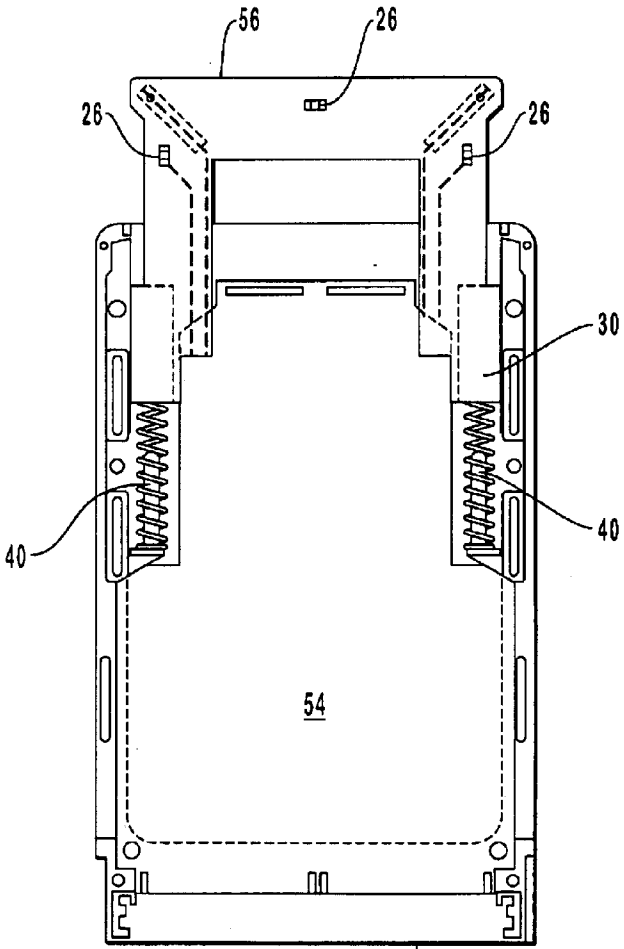
FIGS. 7A and 7B are perspective views of a retractable/extendable antenna bridge with the radiating elements arranged spatially outward.
Figure 7A:
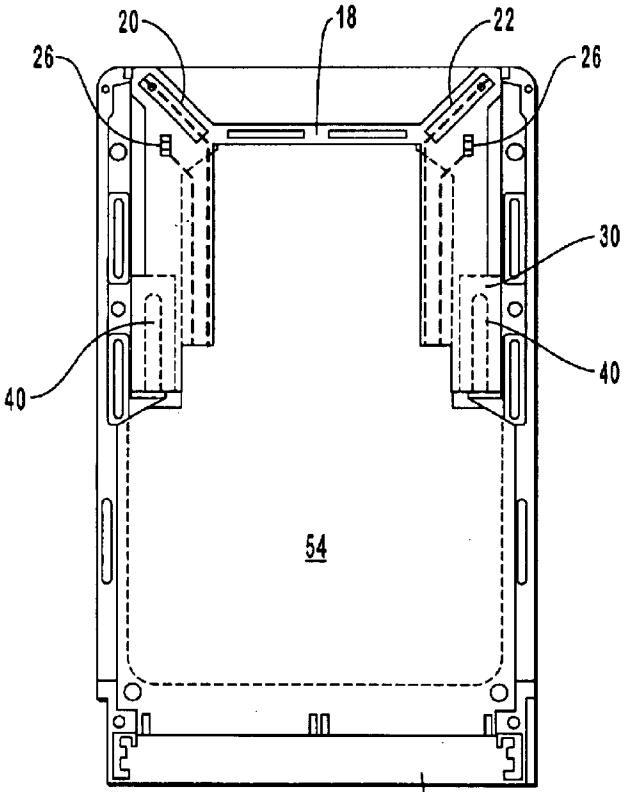

Reference is next made to FIGS. 7A and 7B, which illustrate a wireless PC Card with a single touch retractable antenna bridge 56. The retractable antenna bridge 56 with the radiating antenna elements 20 and 22 arranged spatially outwards. The antenna bridge configuration comprises PCB 54, antenna bridge 56, PCMCIA interface 16, and housing interface 18 adapted to receive the antenna bridge 56. Antenna bridge uses guide structures similar to those previously discussed with regards to the retractable antenna arms, with the significant addition of a cross member to tie the supports together. The cross member provides rigidity and strength to the overall antenna structure. The bridge optionally uses two compression springs to extend the bridge horizontally into a position that allows a desired radiation pattern from the antenna elements 20 and 22. When the antenna arm is retracted, a cam track and cam follower design (discussed previously in FIGS. 5A and 5B) prevents the compression spring from extending the bridge prematurely. The bridge optionally has a functional LED 26 to indicate signal activity across the antenna elements 20 and 22.

FIG. 8 illustrates a simplified circuit diagram of antenna circuitry for use with a preferred antenna bridge embodiment. Contact wires 46*a* and 46*b* are in electrically communication with contact points on the PC Card PCB. Antenna modules 41 and 43 are electrically connected to contact wires 46*a* and 46*b* respectively. Inductors 49*a* and 49*b* electrically isolate LED indicator 26 from the signals being transceived by the antenna modules 41 and 43. Antenna modules 41 and 43 are similar to the radiating antenna elements 20 and 22 in that they are spatially diverse perpendicularly oriented antennas having diverse radiation patterns. The radiation patterns of the antenna modules preferably have spatially orthogonal polar nulls. The antenna modules preferably comprise planar diversity antennas that act as horizontal dipoles, but may also incorporate other antenna types as previously discussed. The antenna modules may also include impedance matching circuitry to maximize the available power for the antenna radiating elements.

Figure 9B:
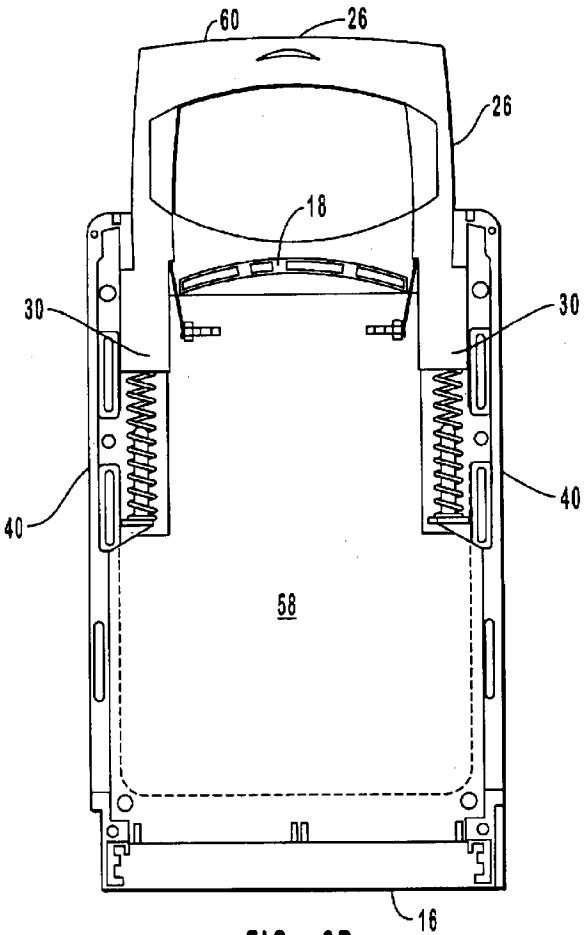
FIGS. 9A and 9B show perspective views of a preferred embodiment of the present invention with and without the antenna assembly housing.
Figure 9A:
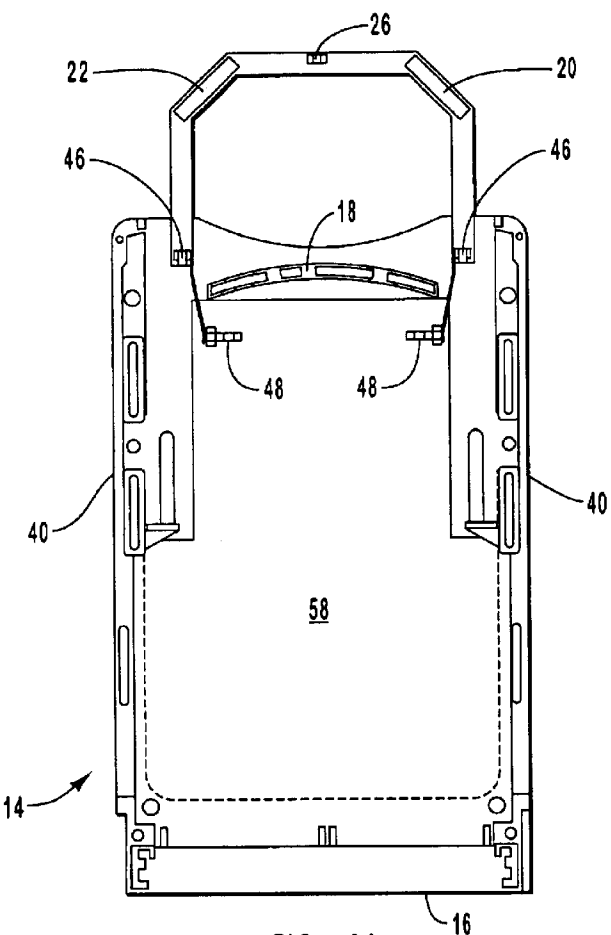

Reference is next made to FIGS. 9A and 9B, illustrating a retractable antenna bridge where the radiating antenna elements are spatially oriented inwards. As previously discussed the radiating antenna elements need only be positioned perpendicular to each other, allowing for a wide variety of orientations. The orientation illustrated in FIG. 9 allows for the support structure of the antenna bridge 60 to follow a curved arch. This orientation not only minimizes the bridge incursion onto the PCB 58, but it also strengthens the support structure making the antenna bridge more robust and durable. The curved retractable antenna bridge 60 may be repeatedly retracted and extended as needed. The curved retractable antenna bridge 60 switches the radiating antenna elements 20 and 22 so that they are arranged spatially inwards. The antenna bridge configuration comprises PCB 58, curved retractable antenna bridge 60, PCMCIA interface 16, and curved housing interface 18 adapted to receive the antenna bridge 56. Antenna bridge 60 also uses guide structures 30 similar to those previously discussed with regards to the retractable antenna arms, with the addition of a curved cross member to tie the supports together. The bridge optionally has a functional LED 26 to indicate signal activity across the antenna elements 20 and 22. The bridge is electrically connected to PCB 58 at PCB contacts 48 via wire contacts 46.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed and desired to be secured by United States Letters Patent is:

1. An apparatus for use with an electronic device to enable wireless communication between the electronic device and a communications network, the apparatus comprising:

a printed circuit board disposed within a housing and containing communications circuitry;

an antenna assembly, electrically connected to the communications circuitry, capable of transmitting and receiving electromagnetic energy in the form of radio waves, the antenna assembly configured to transmit the radio waves in a spatially diverse pattern; and a retractable platform configured so as to substantially contain the antenna assembly, the retractable platform having an extended position and a retracted position, such that in the retracted position the antenna assembly is contained within the electronic device and in the extended position the antenna assembly extends outside of the electronic device, wherein the retractable platform is configured so that at least a portion of the printed circuit board is disposed within the retractable platform when the retractable platform is in the retracted position.

2. The apparatus as defined in claim 1, wherein the antenna assembly comprises at least first and second antenna elements, the first antenna element including a linear portion that is perpendicularly oriented with respect to a linear portion of the second antenna element.

3. The apparatus as defined in claim 2, wherein the at least first and second antenna elements are formed as etched printed circuit board contour antennas.

4. The apparatus as defined in claim 2, wherein the at least first and second antenna elements are planar antennas that act as horizontal dipoles, the first antenna element transmitting a radiation pattern with polar nulls that are spatially orthogonal to polar nulls of a radiation pattern transmitted by the second antenna element.

5. The apparatus as defined in claim 2, wherein the at least first and second antenna elements are positioned on the retractable platform at a distance equal to at least one-quarter the wavelength of radio waves that are transmitted by the at least first and second antenna elements.

6. The apparatus as defined in claim 2, further comprising a visual indicator located on a portion of the retractable platform, the visual indicator capable of indicating the status of at least one of the at least first and second antenna elements.

7. The apparatus as defined in claim 6, wherein the visual indicator comprises at least one light emitting diode.

8. A communications card for use with an electronic device, the communications card comprising:

a printed circuit board disposed within a housing;

communications circuitry disposed on the printed circuit board;

at least one antenna element electrically connected to the communications circuitry and operably supported by a retractable platform that is capable of being positioned in at least an extended position and a retracted position, wherein the at least one antenna element and retractable platform are both disposed substantially within the housing in the retracted position, wherein the retractable platform is configured so that at least a portion of the printed circuit board is disposed within the retractable platform when in the retracted position;

at least one biasing mechanism operably connected to the retractable platform to urge the platform into an extended position, the at least one biasing mechanism being disposed between an interior portion of the housing and an outer periphery of the printed circuit board; and a guide structure, at least partially formed within the retractable platform, that is configured to maintain a substantially constant lateral position of the retractable platform as it s maneuvered between the extended position and the retracted position.

9. The communications card as defined in claim 8, wherein the at least one biasing mechanism is a spring.

10. The communications card as defined in claim 8, wherein the guide structure is comprised of a slot formed in the retractable platform, and a post connected to the card, wherein the post is at least partially received within the slot during movement between the retracted position and the extended position.

11. The communications card as defined in claim 8, wherein the card comprises two biasing mechanisms that are each disposed within the card so as to be located at opposing sides of the printed circuit board from one another.

12. The communications card as defined in claim 8, further comprising a first electrical contact located on the retractable platform and a second electrical contact located on the printed circuit board, wherein the first and second electrical contacts are electrically connected when the retractable platform is brought into the extended position such that the at least one antenna element is able to transmit and receive electromagnetic energy.

13. The communications card as defined in claim 8, wherein the at least one antenna element comprises first and second antenna elements that are located on the retractable platform in a perpendicular orientation with respect to one another.

14. The communications card for use with an electronic device, the communications card comprising:

a printed circuit board disposed within a housing;

communications circuitry disposed on the printed circuit board; and a retractable platform that is capable of being positioned in at least an extended position and a retracted position relative to the housing, wherein the retractable platform forms an antenna bridge that is in the form of a curved arch that contains at least one antenna element that is electrically connected to the communications circuitry, and wherein the at least one antenna element is substantially disposed within the housing when the platform is in the retracted position.

15. The communications card as defined in claim 14, wherein the antenna bridge is disposed substantially adjacent to the outer periphery of the printed circuit board when the retractable platform is placed in the retracted position.

16. The communications card as defined in claim 14, further comprising a guide structure, at least partially formed within the retractable platform, that is configured to maintain a substantially constant lateral position of the retractable platform as it is maneuvered between the extended position and the retracted position.

17. The communications card as defined in claim 14, further comprising at least one biasing mechanism operably connected to the retractable platform to urge the platform into an extended position, the at least one biasing mechanism being disposed between an interior portion of the housing and an outer periphery of the printed circuit board.

18. The communications card as defined in claim 14, wherein the at least one antenna element comprises first and second antenna elements, each antenna element including a linear portion, the linear portions being disposed at right angles to one another.

19. A wireless network interface card for use with a portable electronic device, the wireless card comprising:

a housing for mechanically interfacing with the portable electronic device and being received therein;

a printed circuit board located within the housing; and first and second antenna elements each disposed in a spaced apart relationship on respective arms portions of a retractable platform that is capable of being positioned in at least an extended position and a retracted position, the first and second antenna elements being disposed substantially within the housing of the wireless network interface card and in a manner such that arms are disposed along an outer periphery of the printed circuit board when the retractable platform is in the retracted position, and wherein a longitudinal linear portion of the first antenna element is perpendicularly positioned on the retractable platform with respect to a longitudinal linear portion of the second antenna element.

20. The card as defined in claim 19, further comprising a spring, wherein the spring is connected so as to exert an extension force to extend the retractable platform from within the housing of the wireless network interface card.

21. The card as defined in claim 20, further comprising a flex circuit that electrically connects the printed circuit board to the retractable platform.

22. The card as defined in claim 21, wherein the spring comprises a compression spring, and wherein the flex circuit is physically bonded to the spring.

23. The card as defined in claim 19, wherein the first and second antenna elements are configured to function only when the retractable platform is in the extended positioned.

24. The card as defined in claim 19, wherein the antenna elements are planar antennas.

25. The card as defined in claim 19, wherein the first and second antenna elements are formed as etched printed circuit board PCB contour antennas.

26. The card as defined in claim 19, wherein the first antenna element comprises a first antenna type, and wherein the second antenna element comprises a second antenna type, the first and second antenna types being selected from the group consisting of patch antennas, aperture antennas, reflector antennas, lens antennas, fractal antennas, wire antennas, etched PCB contour antennas, loop antennas, straight wire antennas, helix antennas, spiral antennas, and inverted 'F' antennas.

27. A wireless network interface card for use with a portable electronic device, the wireless card comprising:

a housing for mechanically interfacing with the portable electronic device and being received therein;

a printed circuit board located within the housing;

a first retractable platform that is capable of being positioned in an extended position substantially outside the housing and a retracted position substantially within the housing, the first retractable platform including a first antenna element;

a second retractable platform that is capable of being positioned in an extended position substantially outside the housing and a retracted position substantially within the housing, the second retractable platform including a second antenna element; and wherein the first retractable platform and the second retractable platform are each configured for extension and retraction independent of the other.

28. The card as recited in claim 27, wherein the first and second antenna elements are each linearly shaped to have a longitudinal axis.

29. The card as recited in claim 28, wherein the longitudinal axis of the first antenna element is positioned perpendicularly with respect to the longitudinal axis of the second antenna element when the first and the second retractable platforms are in the extended positions.

30. The card as recited in claim 27, wherein the first retractable platform includes a first guide structure and the second retractable platform includes a second guide structure, the first and second guide structures operable to respectively enable the extension and retraction of the first and second retractable platforms.

31. The card as recited in claim 27, wherein the extension and retraction of the first and second retractable platforms is enabled by a single guide structure.

32. The card as recited in claim 27, further comprising a first light emitting diode located on the first retractable platform and a second light emitting diode located on the second retractable platform, the first and second light emitting diodes capable of respectively indicating the status of the first and second antenna elements.

33. A communications card for use with an electronic device, the communications card comprising:

a printed circuit board disposed within a housing;

communications circuitry disposed on the printed circuit board;

at least one antenna element electrically connected to the communications circuitry and operably supported by a retractable platform that is capable of being positioned in at least an extended position and a retracted position wherein the at least one antenna clement and retractable platform are both disposed substantially within the housing in the retracted position;

at least one biasing mechanism operably connected to the retractable platform to urge the platform into an extended position; and a guide structure comprised of a slot formed in the retractable platform, and a post connected to the card, wherein the post is at least partially received within the slot during movement between the retracted and the extended positions.

* * * * *